United States Patent [19]

Frazier

[11] Patent Number: 4,485,852

[45] Date of Patent: Dec. 4, 1984

[54] APPARATUS AND METHOD FOR REMOVING SLACK IN WIRE FENCES

[76] Inventor: Harold L. Frazier, Rte. #2, Box 2343, Red Bluff, Calif. 96080

[21] Appl. No.: 463,611

[22] Filed: Feb. 3, 1983

[51] Int. Cl.[3] ..... B21F 7/00

[52] U.S. Cl. ..... 140/118; 140/102.5; 140/106

[58] Field of Search ..... 140/106, 117, 118, 123, 140/124, 102.5, 123.5; 24/71.3

[56] References Cited

U.S. PATENT DOCUMENTS

| | | | |
|---|---|---|---|
| 1,805,797 | 5/1931 | Bates | 140/106 |
| 2,484,278 | 10/1949 | Fisher | 140/117 |
| 3,168,118 | 2/1965 | Holman | 140/118 |
| 3,847,189 | 11/1974 | Gueza | 140/106 |
| 4,041,992 | 8/1977 | Lynn | 140/123.5 |
| 4,195,401 | 4/1980 | Galloup | 140/123 |
| 4,257,159 | 3/1981 | Wingeret | 140/106 |

*Primary Examiner*—W. D. Bray

*Attorney, Agent, or Firm*—Harris Zimmerman; Howard Cohen

[57] ABSTRACT

A tool for removing slack in wire fences and the like includes a shank having a handle at one end and a first slot extending axially into the other end for engaging a fence wire. A second slot extending axially into the other end of the shank and angularly offset from the first is adapted to receive the bail of a generally rectangular wire clip. The shank includes grooves extending longitudinally from the second slot to engage the legs of the wire clip. The handle is rotated to wrap the wire about the other end to remove slack in the wire. The legs of the wire clip are then wound about the fence wire adjacent to the wrap to retain the wrap in the fence wire.

11 Claims, 13 Drawing Figures

APPARATUS AND METHOD FOR REMOVING SLACK IN WIRE FENCES

BACKGROUND OF THE INVENTION

The following U.S. patents comprise the closest known prior art:

| | |
|---|---|
| 423,514 | 1,789,891 |
| 659,666 | 1,975,110 |
| 898,912 | 2,086,315 |
| 993,571 | 2,195,773 |
| 1,561,881 | 2,484,278 |
| 1,613,871 | 4,041,992 |

Since the inception of wire fences, and in particular barbed wire fences, it has been recognized that the wire strands that comprise the fence often become slack and loose. Slack wire seriously degrades the ability of the fence to retain livestock or to repel intruders. The wire strands become slack due to the fact that the metal which forms the strands will yield in plastic fashion under tension, thus elongating and sagging. This effect may be caused by livestock pushing against the wire strands or against the fence posts. In any case it is often necessary to maintain wire fences and to take up the slack which frequently forms in the wire strands.

There are known in the prior art many devices for removing slack in the strands of a wire fence. Such devices generally comprise a tool for twisting or wrapping the fence strands to remove the slack therein. In addition, it is usually necessary to retain the twisted or wrapped portion in the fence strand by applying a wire tie or clip to the twisted portion. Experience has shown that the use of such tools often results in breaking the wire strands of the fence. This is usually due to the fact that the twisted or wrapped portion of the fence strand is highly stressed and incapable of supporting the tension in the strand. Even if the twisted or crimped fence wire portion does not break immediately, it is seriously weakened and likely to fail and break under the slightest additional stress. Also, many of the prior art tools are designed to impart multiple twists or wraps to the fence strands, thus exacerbating this problem. Furthermore, it is often difficult to manipulate the prior art fence tightening tools while at the same time applying the retaining wire or clip. When working with barbed wire fences, an individual must wear heavy protective gloves, making such a task quite laborious and difficult.

SUMMARY OF THE PRESENT INVENTION

The present invention generally comprises an apparatus and method for taking up slack which usually develops in wire fences and the like. The present invention is superior to prior art devices in that it is much easier and faster to use, it does not break the fence wire, and it provides stress relief of the portion of the fence strand which is bent to take up the slack.

The tool of the present invention for removing slack in wire fences and the like includes a shank having a handle extending orthogonally at one end thereof and a first slot extending axially into the other end for engaging a fence wire. A second, shallower slot extending axially into the other end of the shank and angularly offset from the first is adapted to receive the bail of a generally rectangular wire retaining clip. The shank includes grooves extending longitudinally from the second slot to engage the legs of the retaining clip. The handle is operated to rotate the shank to wrap the wire about the other end to remove slack in the wire. The bends in the fence wire are actually formed about the proximal leg portions of the retaining clip to prevent cutting or breaking of the fence wire. The legs of the wire clip are then wound about the fence wire adjacent to the wrap to retain the wrap in the fence wire. The tension in the fence wire is supported by the retaining clip, thus assuring that the tightening procedure has not weakened the fence.

DESCRIPTION OF THE PREFERRED EMBODIMENT

Figure 1:
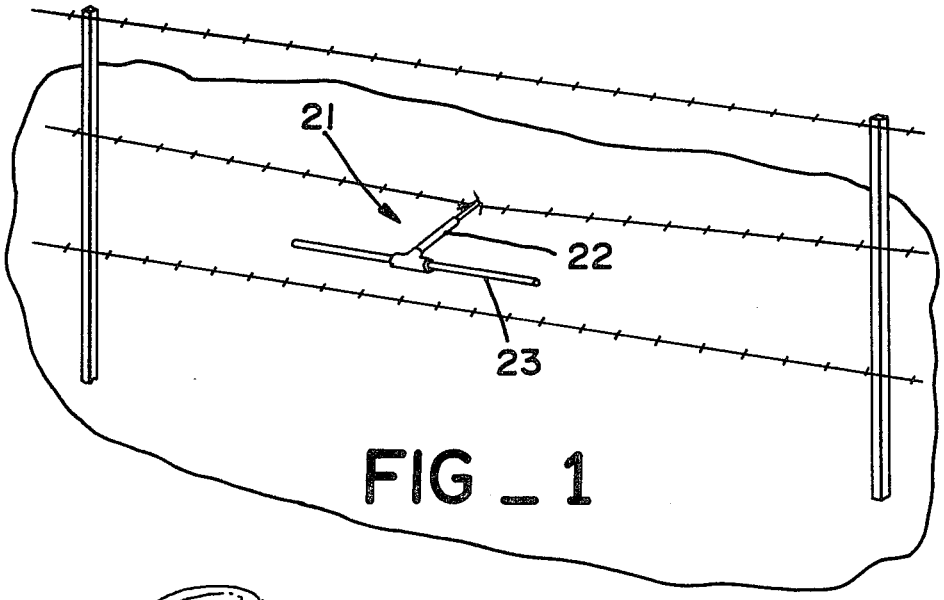
FIG. 1 is a perspective view of the tool of the present invention, shown engaged in a typical wire fence.

The present invention generally comprises a method and apparatus for removing the slack in wire fences, and in particular barbed wire fences. With reference to FIG. 1, the apparatus of the invention includes a hand tool 21 having a shank 22. Joined to the proximal end of the shank 21 and extending generally orthogonally therefrom is a handle 23. The handle is provided to facilitate rotation of the shank 21, as will be explained in the following description.

Figure 2:
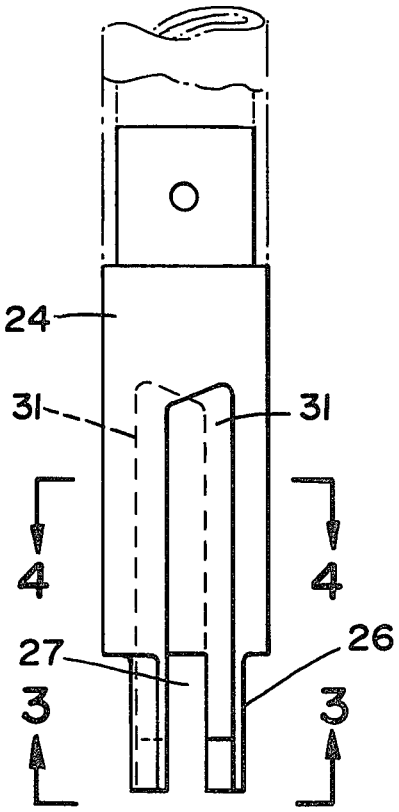
FIG. 2 is a side elevation of the fence wire engaging portion of the tool of the present invention.
Figure 4:
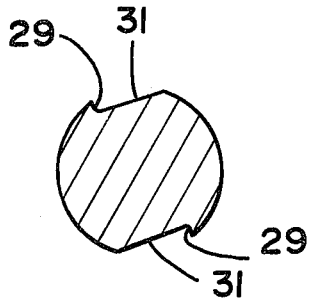
FIG. 4 is a cross-sectional view of the fence wire tightening tool, taken along line 4—4 of FIG. 2.
Figure 3:
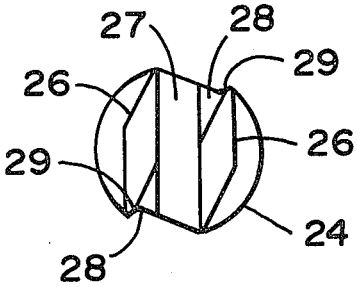
FIG. 3 is a end view of the fence wire tightening tool, taken along line 3—3 of FIG. 2.

With reference to FIG. 2, the distal end of the shank 22 includes a mandrel 24 which is adapted to engage a fence wire strand. The mandrel is provided with a reduced diameter portion 26 directly adjacent to the distal end thereof. A deep slot 27 extends axially into the distal end of the mandrel, and is oriented in a generally diametrical fashion. The slot 27 is adapted to engage a fence wire strand therein. Another slot 28 also extends axially into the distal end of the mandrel. The slot 28 is shallower and narrower than the slot 27, and is angularly offset therefrom along another diameter of the mandrel.

The slot 28 is adapted to receive and retain the bail of a wire retaining clip, as will be described in the following. The mandrel also includes a pair of diametrically opposed grooves 31 extending longitudinally and proximally from the opposed ends of the slot 28. The grooves 31 are disposed to receive the leg portions of a wire retaining clip. The grooves 31 each are provided with a lip 29 extending longitudinally along one side thereof and forming an acute angle with the inner surface of the groove, the opposed side of each groove blending smoothly with the curvature of the outer surface of the mandrel.

Figure 5:
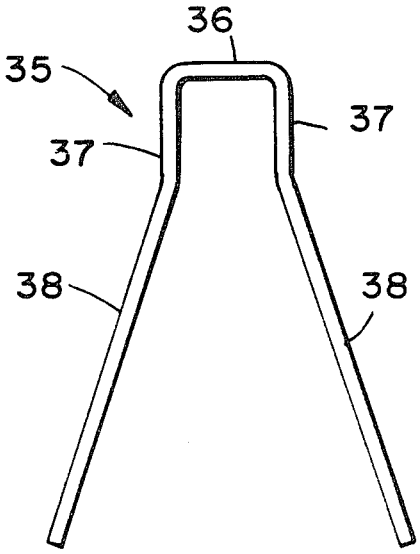
FIG. 5 is a front elevation of the wire retaining clip of the present invention.

As depicted in FIG. 5, the apparatus of the present invention also includes a wire retaining clip 35. The retaining clip includes a medial bail portion 36, and a pair of leg members 37 extending from opposed ends thereof in generally orthogonal fashion. Each leg member includes a bend in a proximal portion thereof so that the medial and distal portions of the legs flare and diverge angularly outwardly. The retaining clips may be formed of high strength steel wire or the like.

The apparatus of the present invention further includes a wire bending tool 41, shown in FIGS. 9–12, for winding the legs of the retaining clips 35 about a fence wire strand. The tool 41 includes a shaft 42 having a bore 43 extending axially therein and dimensioned to receive a leg member 38 of a retaining clip 35.

Figure 6:
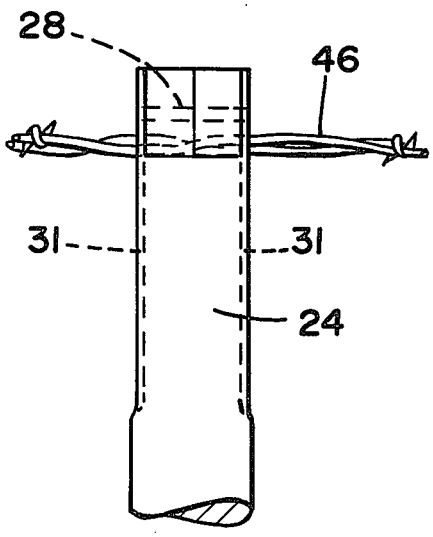
FIGS. 6–12 are sequential views depicting the operative steps of the method of the present invention, including engaging the fence wire strand with the tool (FIG. 6), securing a wire retaining clip in the tool (FIG. 7), rotating the tool to wrap the fence wire strand about the tool (FIG. 8), winding one leg of the retaining clip about the fence wire strand (FIGS. 9 and 10), winding the other leg of the retaining clip about the fence wire strand (FIG. 11), and disengaging the tool from the fence wire strand (FIG. 12).
Figure 7:
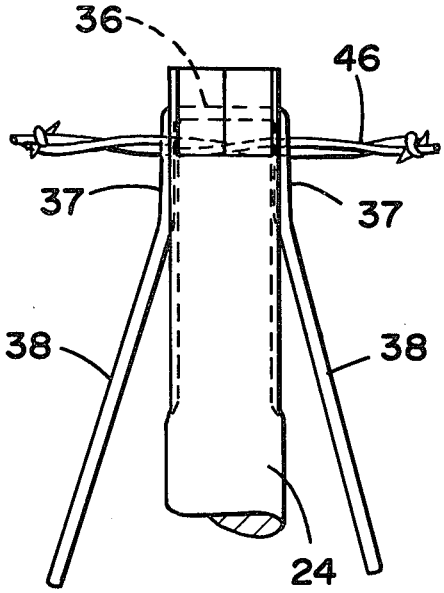

The method of the present invention employs the apparatus to remove slack and restore tension in a fence wire strand. With reference to FIG. 6, the shank 22 of the tool 21 is disposed laterally so that the slot 27 is aligned with a fence wire strand which is slack and requires tightening. The fence wire strand 46 is placed in the slot 27, and disposed in the most proximal portion thereof. As shown in FIG. 7, a wire retaining clip 35 is then placed in the slot 28, with the leg members 38 of the clip engaging the grooves 31. It should be noted that the slot 28 is sufficiently narrow so that the bail 36 of the clip is retained in the slot, so that no manual effort is required to support the clip while the tool is being employed. Also, the bail length is dimensioned so that the leg portions 37 of the clip resiliently engage the grooves 31.

Figure 8:
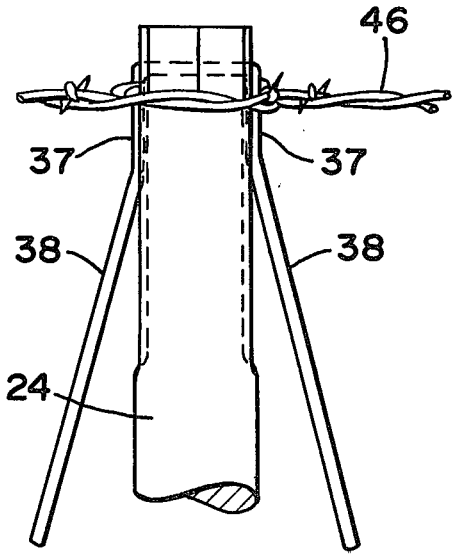

The handle 23 is then rotated clockwise 180 degrees about the axis of the shank 22 to impart two bends in the wire strand 46, as shown in FIG. 8. This action shortens the total length of the strand, creating greater tension and removing slack therein. It should be noted that the bends in the wire strand 46 are formed about the leg members 37 of the retaining clip, thus assuring that the bends have sufficient radius to prevent undue mechanical strain in the strand. Also, the lips 29 of the grooves 31 engage the leg members 37 during rotation to prevent skewing of the leg members of the retaining clip.

Figure 9:
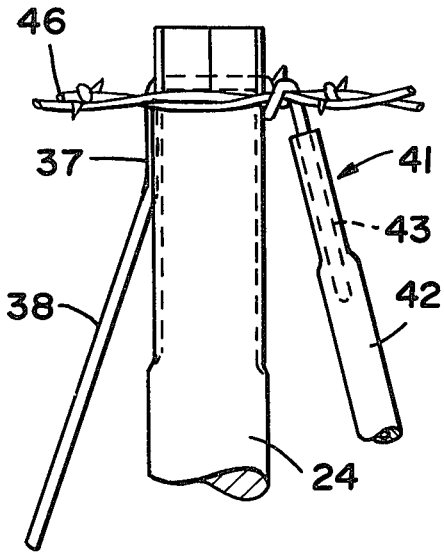
Figure 10:
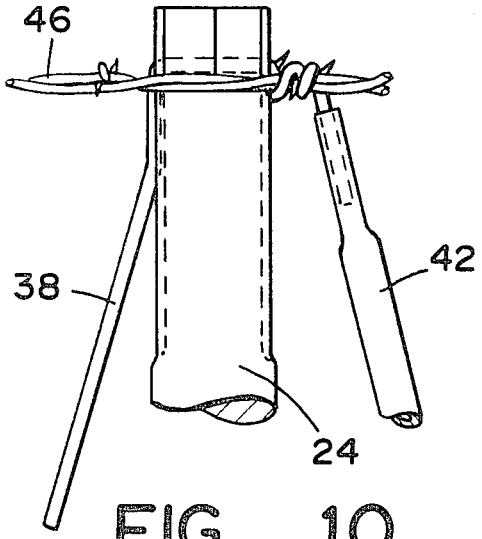
Figure 11:
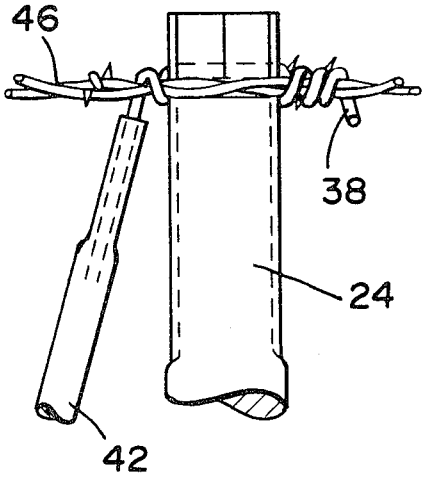
Figure 12:
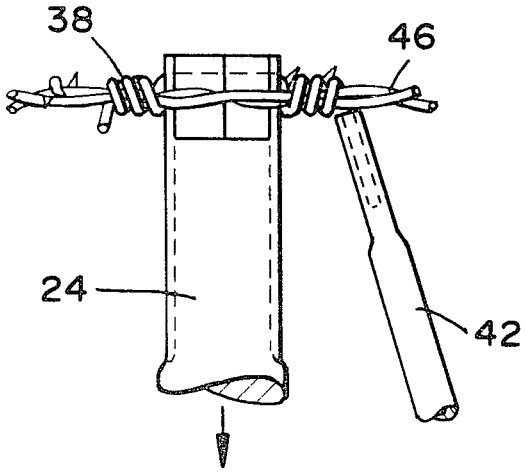

Thereafter the tool 42 is employed to wind the legs of the retaining clip about the strand 46. One of the leg members 38 is inserted in the bore 41 of the tool, and is wound approximately three times about the strand, as depicted in FIGS. 9 and 10. The other leg member 38 of the clip is then also wound approximately three times about the strand 46, as shown in FIGS. 11 and 12, again using the tool 42. The tool 21 is then withdrawn from engagement with the wire strand and the clip, and the procedure is completed.

Figure 13:
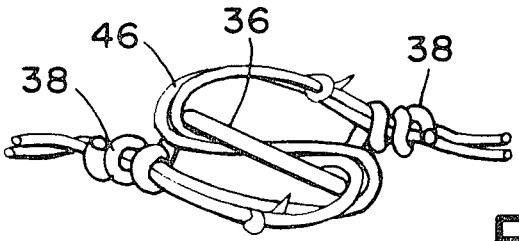
FIG. 13 is a side elevation of the completed and tightened fence wire strand portion engaged by the wire retaining clip.

The completed retaining clip-strand assembly, shown in FIG. 13, has a nominal S configuration, with the bail 36 of the clip extending diagonally across the S of the wire strand. It is significant that the bends in the wire strand 46 which form the S configuration are rather large in radius, and that the presence of the clip legs prevents the bends from being crushed and weakened. More importantly, it should be appreciated that the leg members of the retaining clip are wound about the strand outwardly of the bends formed therein. Thus the retaining clip is disposed to bear the tension in the wire strand, and any shock or other loading which might be imparted thereto. Furthermore, the portions of the strand 46 outward of the wound clip legs are substantially linear and unbent, so that the strand portions adjacent to the clip are unstressed and possess substantially the same tensile strength as any other portion of the strand.

I claim:

1. Apparatus for removing slack in a wire, including a retaining clip having a medial bail portion and a pair of leg members extending outwardly therefrom, a tool including a shank member, a first slot formed in one end of said shank member adapted for receiving and retaining a portion of the wire, a second slot formed in said one end of said shank member adapted for receiving and retaining said bail portion of said retaining clip closely spaced and generally aligned with said wire portion, means for selectively rotating said shank member about the axis thereof to impart bends in the wire and shorten the length thereof, and means for wrapping said leg members of said retaining clip about the wire adjacent to and outwardly of the bends formed therein to retain said bends and to relieve tension on said wire portion and said bends.

2. The apparatus of claim 1, wherein said first slot extends diametrically across said shank and axially into said one end of shank member, said second slot intersecting said first slot.

3. The apparatus of claim 2, wherein said second slot is more shallow than said first slot.

4. The apparatus of claim 3, wherein said first slot is wider than said second slot.

5. The apparatus of claim 2, further including a pair of grooves extending longitudinally in said shank member and intersecting the opposed ends of said second slot, said grooves being disposed to engage portions of said leg members.

6. The apparatus of claim 1, wherein said bail portion is substantially linear, and said leg members include like proximal portions extending generally orthogonally from said bail portion.

7. The apparatus of claim 6, wherein said leg members include like distal portions diverging angularly outwardly each from the other.

8. The apparatus of claim 1, wherein said means for rotating said shank member includes a handle secured to the other end of said shank member.

9. A wire retaining clip, comprising a medial bail portion extending substantially linearly, a pair of leg members extending generally orthogonally from opposed ends of said bail portion, said leg members including like distal portions diverging angularly outwardly each from the other, said bail portion, leg members, and distal portions being generally disposed in the same plane.

10. A method for removing slack in a tensioned wire, comprising the steps of providing a retaining clip having a medial bail portion and a pair of leg members extending from opposed ends thereof, providing a tool having a first slot for engaging and retaining the wire and a second slot for engaging and retaining the bail portion of the retaining clip, rotating the tool to impart multiple bends in the wire to shorten and remove slack therein, and thereafter winding the legs of the retaining clip about the wire adjacent to and outwardly of the bends formed therein to retain the bends therein and provide stress relief thereof.

11. The method of claim 10, further including the step of locating said first slot and said second slot in intersecting fashion in the end of the tool.

* * * * *